United States Patent [19]

Wataya

[11] Patent Number: 4,969,431

[45] Date of Patent: Nov. 13, 1990

[54] THROTTLE VALVE CONTROL DEVICE FOR AN AUTOMOTIVE ENGINE

[75] Inventor: Seiji Wataya, Himeji, Japan

[73] Assignee: Mitsubishi Denki Kabushiki Kaisha, Tokyo, Japan

[21] Appl. No.: 366,717

[22] Filed: Jun. 15, 1989

[30] Foreign Application Priority Data

Jun. 29, 1988 [JP] Japan ..... 63-162829

[51] Int. Cl.[5] ..... F02D 41/22; F02D 11/10

[52] U.S. Cl. ..... 123/399; 123/198 D

[58] Field of Search ..... 123/198 D, 361, 399

[56] References Cited

U.S. PATENT DOCUMENTS

| | | | |
|---|---|---|---|
| 4,120,373 | 10/1978 | Fleischer | 123/399 X |
| 4,424,785 | 1/1984 | Ishida et al. | 123/478 X |
| 4,603,675 | 8/1986 | Junginger et al. | 123/478 |
| 4,747,380 | 5/1988 | Ejiri et al. | 123/399 |

FOREIGN PATENT DOCUMENTS

| | | | |
|---|---|---|---|
| 43-1687 | 1/1968 | Japan . | |
| 76236 | 5/1982 | Japan . | |
| 153945 | 9/1984 | Japan | 123/361 |

*Primary Examiner*—Tony M. Argenbright
*Attorney, Agent, or Firm*—Sughrue, Mion, Zinn, Macpeak and Seas

[57] ABSTRACT

A throttle valve control device for an automotive engine is disclosed which comprises, in addition to an actuator for driving the throttle valve, an electromagnetic clutch for disconnectably connecting the actuator to the throttle valve, and control means for driving the actuator and the electromagnetic clutch, an interrupter circuit which, being inserted between the electromagnetic clutch and the driver circuit thereof, interrupts the supply of the driving current to the electromagnetic clutch when the following two conditions are satisfied simultaneously: (1) the brake of the automobile is operated by the operator, and (2) the automobile is running at a speed not less than a predetermined level, e.g. 5 km/h. Thus, even if failures occur in the fail detector or the clutch driver circuit in the control means, the automobile can be safely decelerated and stopped by the operator who operates the brake pedal. On the other hand, the automobile can be started uphill by the operation of the brake and the acceleration pedal thereof.

3 Claims, 2 Drawing Sheets

THROTTLE VALVE CONTROL DEVICE FOR AN AUTOMOTIVE ENGINE

BACKGROUND OF THE INVENTION

This invention relates to throttle valve control devices which control the throttle valve of an automotive engine by means of an actuator such as a DC or stepping motor.

Conventionally, the throttle valve of an automotive engine has been mechanically coupled to the acceleration pedal of the automobile. However, for the purpose of improving the operator's driving feeling or providing a constant speed cruising function, the so-called drive-by-wire method has already been proposed and has widely been adopted, by which the throttle valve is driven by an actuator such as a DC or stepping motor. In such throttle valve control devices, the degree of opening of the throttle valve is adjusted by an actuator in response to the outputs of the acceleration pedal kick-in sensor and the speed sensor.

FIG. 1 shows an overall organization of such a throttle valve control device for an automotive engine including an actuator for driving the throttle valve; this device is similar to those disclosed, for example, in Japanese Patent Publication No. 43-1687 and Japanese Laid-Open Patent Application No. 57-76236. As shown in the figure, the supply of a mixture of air and fuel to an internal combustion engine 1 via the air intake pipe 2 is controlled by a throttle valve 3; the valve 3, which rotates on the shaft 3*a*, is urged by a return spring 4 to the position at which it closes the air intake pipe 2 completely. The shaft 3*a* of the throttle valve 3 is coupled, via an electromagnetic clutch 5, to the actuator 6 such as a DC motor or stepping motor. The output shaft of the clutch 5 is coupled to the shaft 3*a* of the throttle valve 3, while the input shaft thereof is coupled to the actuator 6; thus, the electromagnetic clutch 5 connects and disconnects the actuator to and from the shaft 3*a* of the valve 3*a* by means of the friction plates coupled to the input and output shafts thereof.

The actuator 6 and the clutch 5 are driven and controlled by a control means 7, which consists, for example, of a microprocessor. The portion 7*a* for controlling the actuator 6 comprises an actuator controller 71; on the other hand, the portion 7*b* for controlling the clutch 5 comprises a failure detector 72 and a clutch driver circuit 73. The actuator controller 71 controls the actuator 6 to adjust the opening of the throttle valve 3; namely, the actuator controller 71 controls the opening of the valve 3 via the actuator 6 so that the opening of the valve 3 is adjusted in accordance with a function of the following two variables: the amount of kick-in of the acceleration pedal by the operator of the automobile, which is detected by the acceleration pedal kick-in sensor 8 coupled to the acceleration pedal 9, and the speed of the automobile detected by the speed sensor 10. The degree of opening of the throttle valve 3 is usually adjusted in such a manner that a good driving feeling is provided for the operator of the automobile; in the constant speed cruising mode of the automobile, on the other hand, it is set at a level at which the automobile will cruise at the target speed that is detected from the amount of kick-in of the acceleration pedal 9. Thus, in the case of the above device shown in FIG. 1, the opening of the throttle valve 3 is not directly controlled by the acceleration pedal 9; it is controlled via the actuator 6 on the basis of an arbitrarily selected function of the amount of acceleration pedal kick-in, with an automobile speed feedback via the speed sensor 10.

The clutch driver circuit 73, on the other hand, disconnects the clutch 5 when the failure detector 72 detects a failure. Namely, when the acceleration pedal sensor 8 or the actuator 6 fails, the output power of the engine 1 may thereby be increased against the intention of the operator of the automobile; thus, the failure detector 72 detects, for example, occurrences such as: the case where the output of the acceleration pedal sensor 8 is outside of a predetermined range; the case where the actuator 6 becomes incapable of proper operation due to the disconnection in the electrical circuits thereof; or the case where the driving circuit of the actuator 6 fails. In response to the output signal of the failure detector 72, the clutch driver circuit 73 stops the supply of the driving current to the electromagnetic clutch 5 to disconnect the throttle valve 3 from the actuator 6; the throttle valve 3 is thereby urged by the return spring 4 to close the air intake pipe 2.

The above failure detection system, however, has the following disadvantage. Namely, it is difficult to detect the failures as described above with complete certainty. In particular, in the case where the failure detector circuit 72 itself fails simultaneously with other circuits, or where the clutch drive circuit 73 fails, the clutch driver 73 may continue to supply the driving current to the electromagnetic clutch 5 in spite of such failures. Then, the revolutions per minute of the engine may be abnormally increased against the intention of the operator of the automobile. In the worst case, the operator may lose control over the automobile which begins to run away against his or her will.

SUMMARY OF THE INVENTION

It is the primary object of this invention therefore to provide a throttle valve control device for an automotive engine which is capable of preventing an abnormal increase of rpm of the engine even in the case where a crucial circuit, such as the fail detector or the clutch driver circuit, fails, so that the safety of the automobile is ensured.

It is an additional object of the invention to provide such a throttle valve control device which is simple in organization and reliable in operation.

The above objects are accomplished according to the principle of this invention in a throttle valve control device for an automotive engine which comprises, in addition to the circuit portions described above, an interrupter circuit for interrupting the driving current supplied from the clutch driver circuit to the electromagnetic clutch which disconnectably connects the actuator to the throttle valve of the engine. The interrupter circuit according to this invention interrupts the supply of the driving current to the electromagnetic clutch to disconnect the actuator from the throttle valve when the following two conditions are satisfied simultaneously: (1) the brake of the automobile is being operated by the operator of the automobile, and (2) the automobile is running at a speed not less than a predetermined speed (e.g. 5 km/h).

Thus, even if a crucial circuit such as the fail detector or the clutch driver circuit fails during the time when the automboile is running, the automobile can be safely decelerated and stopped by the operator who kicks the braking pedal. The safety of the control device is therefore greatly enhanced according to the invention. On the other hand, upon an uphill starting of the automobile, the supply of the driving current to the electromagnetic clutch is not interrupted since, on such occasions, the speed of the automobile is less than the predetermined value. Thus, the operator can start the automobile from the middle of a slope by operating the brake and the acceleration pedal simultaneously.

BRIEF DESCRIPTION OF THE DRAWINGS

The novel features which are believed to be characteristic of ths invention is set forth with particularity in the appended claims. This invention itself, however, may best be understood from the following detailed description of the preferred embodiment taken in conjunction with the accompanying drawings, in which:

In the drawings, like reference numerals represent like or corresponding parts or portions.

DETAILED DESCRIPTION OF THE PREFERRED EMBODIMENT

Figure 1:
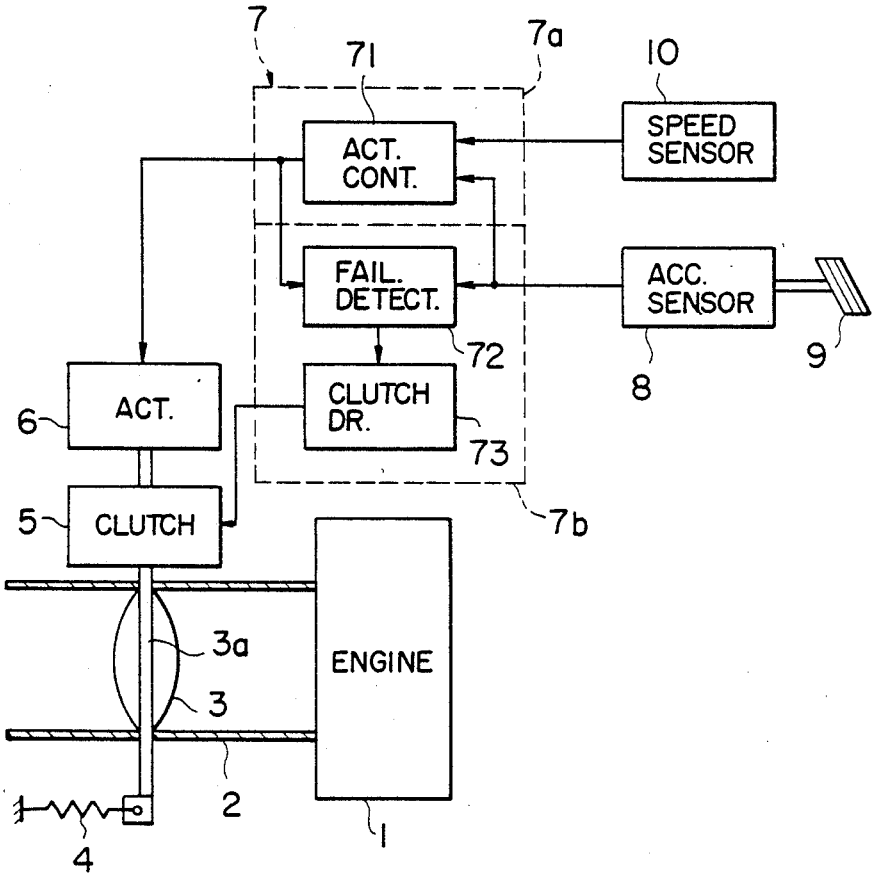
FIG. 1 is a block diagram showing the organization of a throttle valve control device for an automotive engine to which the principle of this invention may be applied.
Figure 2:
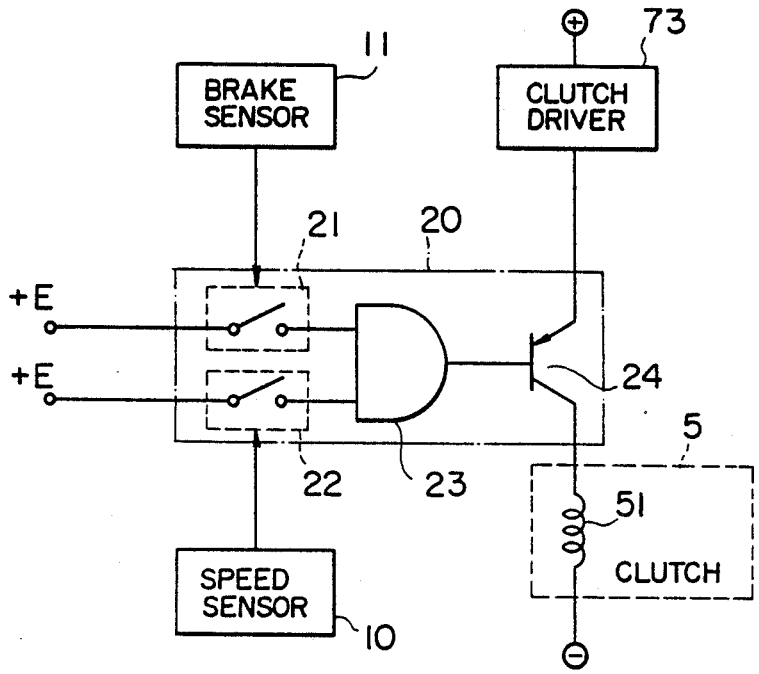
FIG. 2 is a circuit diagram of the essential portion of the control device according to this invention, which may be incorporated into the throttle valve control device of FIG. 1.

Referring now to FIGS. 1 and 2, and in particular to FIG. 2, an embodiment of this invention is described.

FIG. 2 shows a fail-safe circuit 20 according to an embodiment of this invention, which is inserted between the clutch driver circuit 73 of the control means 7 and the coil 51 of the electromagnetic clutch 5 disconnectably connecting the output shaft of the actuator to the throttle valve 3. The circuit 20 according to this invention comprises following portions: a brake sensing switch 21 which is coupled to a constant voltage +E and is made in response to the output of a brake sensor 11 to supply an input signal to an AND gate 23; a speed sensitive switch 22 which is made to supply another input to the AND gate 23 when the output of the speed sensor 10 becomes equal to or greater than a predetermined level (e.g. 5 km/h); an AND gate 23 having two inputs coupled to the switches 21 and 22; and a transistor 24 which is turned off in response to the output of the AND gate 23 to interrupt the supply of the driving current from the clutch driver circuit 73 to the coil 51 of the electromagnetic clutch 5. Except for the addition of the fail-safe circuit 20, the throttle valve control device according to this invention is constructed as described above in reference to FIG. 1.

The operation of the circuit 20 may now be easily comprehended. If the brake of the automobile is operated during the time when the automobile is running at a speed not less than the predetermined level, both the stitches 21 and 22 are made to supply inputs to the AND gate 23, which, in response thereto, outputs a high level voltage to the base of the pnp transistor 24; thus, the transistor 24 is turned off. As a result, irrespective of the output of the clutch driver circuit 73, the supply of the driving current to the coil 51 of the electromagnetic clutch 5 is stopped, to put the coil 51 in the unexcited state. Consequently, the clutch 5 is disconnected, and the throttle valve 3, which is thus disconnected from the actuator 6, is returned to the total closure position, being urged by the spring 4.

Thus, according to this invention, the driving current from the clutch driver circuit 73 is interrupted by the transistor 24 if and only if both inputs to the AND gate 23 are at the logical 1, namely, if the brake is operated during the time when the automobile is running at a speed not less than a predetermined level (e.g. 5 km/h). Namely, the interruption of the driving current from the clutch driver circuit 73 to the coil of the clutch is effected in the following cases according to this invention: Let X be a logical signal which takes the logical value 1 when the brake is operated by the operator of the automobile, and which otherwise takes the logical value 0; further, let Y be another logical signal which takes the logical 1 when the automobile is running at a speed not less than a predetermined speed, and which otherwise takes the logical 0. Then, the driving current from the clutch driver 73 to the clutch 5 is interrupted if and only if the logical product: X.Y of the two signals X and Y is equal to 1.

The reason that the driving current supplied to the clutch 5 is interrupted on the basis of the logical product of the two signals X and Y according to this invention is as follows.

In the normal driving mode of the automobile, the operator of the autombile may be considered to have an intention to decelerate the automobile when he or she does not operate the acceleration pedal 8. Thus, if only the normal driving mode is to be considered, the electromagnetic clutch 5 may be disconnected to close the throttle valve 3 when the acceleration pedal 8 is not operated. However, when the automobile is to be started uphill from the middle of a slope, it is necessary to operate the brake and the engine simultaneously. According to this invention, the supply of the driving current to the electromagnetic clutch 5 is not interrupted by the circuit 20 unless both the brake and the speed signals X and Y as described above are at the logical 1. Thus, during an uphill start of the automobile, the supply of the driving current to the clutch 5 is not interrupted, and hence the throttle valve 3 is connected to and driven by the acutuator 6, since the speed of the automobile is under the predetermined level during the time when the automobile is started.

In the above description, the circuit 20 has been represented as a physically implemented circuit. However, provided that the interruption of the driving current to the electromagnetic clutch 5 is effected by means of the logical product X.Y of the two signals X and Y as described above, the functions of the circuit 20, especially those of the switches 21 and 22 and the AND gate 23, may be effected by means of a program in a microcomputer. Further, to enhance the fail-safe function of the control means 7, it is best preferred to implement the clutch driver circuit 73 independently of the circuit portions (such as a microcomputer) comprising the actuator controller 71.

While description has been made of the particular embodiments of this invention, it will be understood that many modifications may be made without departing from the spirit thereof, and the appended claims are contemplated to cover any such modifications as fall within the true spirit and scope of this invention.

What is claimed is:

1. A throttle valve control device for controlling a throttle valve of an engine of an automobile which adjusts an amount of a supply of an air-fuel mixture to the engine, said control device comprising:

actuator means for driving said throttle valve to adjust an opening of the valve;

actuator controller means for controlling and driving said actuator means;

electromagnetic clutch means for disconnectably connecting said actuator means to said throttle valve;

clutch driver circuit means for supplying a driving current to said electromagnetic clutch means, which, when supplied with the driving current, is thereby energized to connect said actuator means to said throttle valve;

brake detector means for detecting operations of a brake of the automobile by an operator thereof, said brake detector means outputting a brake signal when an operation of the brake by the operator of the automobile is detected;

speed detector means for detecting a speed of the automobile, said speed detector means outputting a speed signal when the detected speed of the automobile is not less than a predeterined value; and interrupter means, having inputs coupled to outputs of said brake detector and speed detector means, for interrupting a supply of the driving current from the clutch driver circuit to the electromagnetic clutch means when both said brake and speed signals are outputted from the brake detector and the speed detector means, the electromagnetic clutch thereby disconnecting the actuator means from the throttle valve.

2. A throttle valve control device as claimed in claim 1, wherein said interrupter means comprises: an AND gate having two inputs coupled to outputs of said brake detector and speed detector means, respectively; and a transistor inserted between an output terminal of said clutch driver circuit means and an input terminal of said electromagnetic clutch means, said transistor having a base terminal coupled to an output of said AND gate, wherein said transistor is turned off in response to an output of said AND gate.

3. A throttle valve control device as claimed in claim 1 or 2, wherein said speed detector means ouputs the speed signal when the speed of the automobile is not less than 5 km/hr.

* * * * *